US008662346B2

(12) United States Patent
Langen et al.

(10) Patent No.: US 8,662,346 B2
(45) Date of Patent: Mar. 4, 2014

(54) APPARATUS AND METHOD FOR DISPENSING AND FOLDING OF SHEETS FROM A STACK

(75) Inventors: Johannes Christina Langen, Cuijk (NL); Herman Josef Langen, Amstelveen (NL)

(73) Assignee: Infostop, B.V., Amersfoort (NL)

( * ) Notice: Subject to any disclaimer, the term of this patent is extended or adjusted under 35 U.S.C. 154(b) by 1307 days.

(21) Appl. No.: 11/663,992

(22) PCT Filed: Sep. 28, 2005

(86) PCT No.: PCT/NL2005/000702

§ 371 (c)(1),
(2), (4) Date: Nov. 13, 2007

(87) PCT Pub. No.: WO2006/036061

PCT Pub. Date: Apr. 6, 2006

(65) Prior Publication Data

US 2008/0197142 A1 Aug. 21, 2008

(30) Foreign Application Priority Data

Sep. 28, 2004 (NL) ..... 1027125

(51) Int. Cl.
*B65H 45/26* (2006.01)
*A47K 10/44* (2006.01)
*G07F 11/04* (2006.01)

(52) U.S. Cl.
USPC ..... 221/43; 221/47; 221/36; 221/42; 221/33

(58) Field of Classification Search
USPC ..... 221/15–16, 33, 36, 42, 43, 47
See application file for complete search history.

(56) References Cited

U.S. PATENT DOCUMENTS

| | | | | |
|---|---|---|---|---|
| 1,458,463 | A | 6/1923 | Braunstein | |
| 1,834,566 | A | 12/1931 | Winkler et al. | |
| 2,118,627 | A * | 5/1938 | Steiner | 226/131 |
| 2,478,815 | A | 8/1949 | Forman | |
| 2,493,410 | A * | 1/1950 | La Cour | 493/419 |
| 3,057,621 | A | 10/1962 | Klaus | |
| 3,136,451 | A | 6/1964 | Deane | |
| 3,226,110 | A * | 12/1965 | Greene | 221/16 |
| 3,608,891 | A * | 9/1971 | Hannon et al. | 271/23 |
| 3,797,701 | A * | 3/1974 | Allocco et al. | 221/155 |
| 3,894,905 | A * | 7/1975 | Ehlscheid | 156/384 |
| 4,042,147 | A | 8/1977 | Lee | |

(Continued)

FOREIGN PATENT DOCUMENTS

| | | |
|---|---|---|
| CH | 250080 | 8/1947 |
| DE | 455813 | 2/1928 |
| JP | 3-232631 | 10/1991 |

OTHER PUBLICATIONS

International Search Report (PCT/ISA/210).

*Primary Examiner* — Michael K Collins
(74) *Attorney, Agent, or Firm* — Harness, Dickey & Pierce, PLC

(57) ABSTRACT

A removing mechanism is disclosed for removing the bottom or top sheet from a stack of sheets; a delaying member for a delay of a predetermined time between the dispensing of two successive sheets; and an actuating mechanism for driving the removing mechanism, wherein the actuating mechanism is driven via a physically supplied mechanical drive force of an operator of the dispensing apparatus.

25 Claims, 12 Drawing Sheets

(56) References Cited

U.S. PATENT DOCUMENTS

| | | | | |
|---|---|---|---|---|
| 4,245,833 | A * | 1/1981 | Akerstrom | 271/198 |
| 4,348,019 | A * | 9/1982 | Stievenart et al. | 271/10.09 |
| 4,384,019 | A * | 5/1983 | Haataja | 428/106 |
| 4,643,705 | A * | 2/1987 | Bober | 493/444 |
| 5,364,332 | A * | 11/1994 | Gray, Jr. | 493/23 |
| 6,554,158 | B2 * | 4/2003 | Kapiloff et al. | 221/277 |
| 2002/0053185 | A1 * | 5/2002 | Gerber | 53/399 |
| 2004/0050857 | A1 | 3/2004 | Norton | |

* cited by examiner

APPARATUS AND METHOD FOR DISPENSING AND FOLDING OF SHEETS FROM A STACK

BACKGROUND OF THE INVENTION

1. Field of the Invention

The present invention relates to a dispensing apparatus for sheets, a removing mechanism for removing a sheet from a stack of sheets, and to a method for dispensing sheets from a stack. It is often desired to distribute sheets such as maps sheets of paper, handouts, cards and the like to members of the public, without supervision, in a public space. Simply placing a box of sheets or a stack of sheets has the possible consequences that someone either takes a substantial part of or the whole stack or that the stack becomes soiled or is damaged, which causes have the result that the desired purpose is not achieved with the stack of sheets.

2. Related Art

It is therefore desirable for an apparatus to be provided for distributing the sheets among the public without the above-stated drawbacks occurring and wherein sheets can nevertheless be made available to the public in practical manner.

SUMMARY OF THE INVENTION

In order to achieve the above stated objective, the present invention provides a dispensing apparatus for sheets, comprising:

- a removing mechanism for removing the bottom or top sheet from a stack of sheets,
- a delaying member for a delay of a predetermined time between the dispensing of two successive sheets,
- an actuating mechanism for driving the removing mechanism, wherein the actuating mechanism is driven by means of a physically supplied mechanical drive force of an operator of the dispensing apparatus.

An advantage of embodiments according to the present invention is that, due to the time delay, a member of the public with improper intentions, for instance due to boredom caused by a long wait, will for instance not take too many sheets. Due to a housing it is impossible for a member of the public to grab a substantial part of the stack. An advantage of such an apparatus is that a one-by-one, controlled take-up of a sheet from a stack can be realized. A further advantage of such an apparatus is that, because physically supplied mechanical drive force of an operator is used to drive the removing mechanism, a mechanical construction can be applied and that the apparatus does not require an external energy source. The apparatus is hereby readily (dis)placeable and can be applied at remote locations such as bus stops or car parks. The embodiment is preferably provided with a handle for operating the actuating mechanism with human muscle power. By means of an arm a moment is exerted by this handle on the actuating mechanism with which the removing mechanism is driven. A sheet can hereby be removed with relatively limited force.

A further aspect according to the present invention relates to a removing mechanism for removing a sheet from the bottom of a stack of sheets, comprising:

- a support member for supporting the stack of sheets,—two counter-rotatable rollers situated in the immediate vicinity of or contacting the bottom or top sheet of the stack,
- an actuating mechanism for driving the counter-rotatable rollers, and—means for causing an engagement, by means of frictional forces, between at least one of the rollers and the bottom or top sheet of the stack during one or more rotation stages of the rollers.

In a preferred embodiment the rollers comprise a surface with a low friction wherein the surface of the rollers, as seen in the longitudinal direction, comprises a strip with a high friction. An advantage is that, because the rollers comprise a surface with a low friction as well as a strip with a high friction, as soon as the end of the bottom sheet is situated substantially close to the top side of the roller and the sheet situated above this sheet will touch the roller, this second sheet situated thereabove will be prevented from touching the smooth surface, whereby it remains in place due to the low friction. It is hereby possible with such an apparatus to first feed the entire bottom sheet through between the rollers before the second sheet is engaged by the surface part with the high friction. A suitable adjustment between the paper size and the roller diameter and the strip width contributes toward the optimization hereof.

In an embodiment according to the present invention, the counter-rotatable rollers comprise an elastic material close to the surface thereof. A suitable choice of such a material prevents possible jamming of the removing mechanism if the surface of the roller is somewhat uneven or if the sheet for feeding through is slightly too thick for the distance between the rollers. This measure is also helpful in the throughfeed of possibly multiple sheets of paper in the event these stick together. The removing mechanism hereby becomes robust enough to prevent malfunction.

In a further embodiment the strip with the high friction has a slightly raised surface relative to the rest of the surface of the roller. It hereby becomes possible to realize a relatively large distance between the rollers, while the engagement by the strip with the high friction is maintained. The strip can further be somewhat yielding compared to the rest of the roller, for instance in order to prevent the above stated paper jam.

The high-friction strip is preferably fixed in the roller. A rather robust embodiment of the high-friction strip is hereby realized. This is for instance practical when a strip of material is used which has good frictional properties but which is not very strong in thin layers. It is possible here to envisage a thickness of the strip of several millimeters to several centimeters. Alternatively, the strip with high friction is arranged on the surface of the roller. It is possible here to envisage a strip which is adhered to the surface of an otherwise flat roller. This is for instance practical in an embodiment wherein the roller comprises a metal surface. A further advantage of a roller with a metal surface is that manufacturing techniques therefor enable a very high surface precision in the manufacture thereof. The strip with high friction is further preferably provided with resistance means such as teeth, ridges, needles and/or studs, and can optionally be arranged in freely movable manner in the immediate vicinity of or against the surface of at least one of the rollers. Just as a natural rubber or plastic surface, such means can provide resistance to a sheet of paper to be entrained. Such an embodiment has the advantage that the strip with the high friction can be moved to or held away from the point of engagement independently of the rotation of the rollers. Disruptions in the mechanism can hereby be prevented or solved in simple manner, for instance by causing sheets situated between the rollers to rotate and feeding them through, while the strip is held for instance on the underside of the roller during this process.

In a further preferred embodiment the removing mechanism comprises a lifting member for varying the height position of the stack of sheets close to the rollers during one or more stages of rotation of the rollers. This embodiment for the means for causing an engagement between at least one of the rollers and the bottom sheet of the stack by means of frictional force during one or more stages of rotation of the rollers has the advantage that rollers can be applied whose whole surface, or a large part of the surface, has a high friction. Lifting the stack of sheets during one or more stages of rotation of the rollers prevents a subsequent sheet being pulled along as soon as the bottom sheet has been advanced so far by the through-feed that the sheet situated thereabove comes into contact with the rollers. The second sheet is therefore prevented from being entrained prematurely, and the effect is achieved that the sheets are dispensed independently of each other. The lifting member preferably comprises two lifting supports on either side of the rollers. It hereby becomes possible to ensure the desired contact with the rollers in simple and precise manner. The lifting supports are preferably placed at an angle relative to the stack of sheets. A more lateral movement and force can hereby be exerted on this stack still to be dispensed, whereby sagging of the sheets between the rollers is prevented. Engaging means are preferably provided to further prevent this sagging of the sheets. These engaging means consist of a shaft which is driven simultaneously with the lifting supports and to which pins or strips are fixed which pull the stack of sheets outward. In an alternative embodiment, the engaging means are embodied as rollers which are optionally provided with friction means.

A cam is preferably arranged on an outer end of at least one of the rollers for the purpose of actuating the lifting member. In relatively simple manner an accurate driving of the lifting member can hereby be realized, with predetermined lifting moments related to the position of the rollers.

The removing mechanism preferably further comprises means for placing the stack and the rollers under bias relative to each other. If the rollers are arranged on the top side of the stack, the stack is for instance pressed under bias against the rollers by means of a spring construction. An alternative here is that the rollers rest on the stack. It is possible here for the weight of the rollers to be at least partly compensated by a counterweight or a number of springs under bias. The mounting of the rollers preferably allows at least a play in the direction of the rollers relative to each other for the purpose of making it possible for the rollers to move apart relative to each other. It is possible here to envisage horizontally movable, biased rollers or for instance flexible shafts. Jamming of the apparatus in particular can hereby be prevented. In a further preferred embodiment, the transition between the coefficient of friction of a roller and the high-friction strip proceeds gradually in predetermined manner. It hereby becomes possible to cause the engagement of the sheet of paper to proceed gradually, whereby the peak load of engagement will be reduced.

A further aspect of the present invention relates to a dispensing apparatus for sheets as specified in the foregoing, comprising a removing mechanism as specified in the foregoing. A dispensing apparatus for sheets can hereby be applied at locations where energy supply is problematic.

A further aspect according to the present invention relates to a dispensing apparatus for sheets, comprising a removing mechanism as specified in the foregoing, comprising:

a motor for driving the removing mechanism, a delaying member for allowing the removing mechanism to be driven by the motor with a time delay, with a predetermined time between the dispensing of two sheets. Such an apparatus provides the option that the delay of the delaying member can for instance be varied in simple manner by setting thereof in electrical or electronic manner. A further setting which is for instance possible is that a user can for instance set that he/she wants two or more sheets and that these are dispensed within a short time of each other, wherein a delay of a longer duration is then observed.

A further aspect of the present invention relates to a method for dispensing sheets from a stack, comprising steps for:

urging a bottom sheet of the stack between two counter-rotatable rollers by means of friction from two sides, wherein the outer ends of the sheets are pulled along,—feeding the bottom sheet through between the rollers, wherein:

the friction between the bottom sheet and at least one roller is generated during at least one or more stages of rotation of the rollers. This method and further methods to be further specified on the basis of embodiments have advantages as indicated in the foregoing or which will be further elucidated on the basis of the description of the embodiments.

Further advantages, features and details of the present invention will be elucidated on the basis of a description of embodiments with reference to the annexed figures.

DETAILED DESCRIPTION

Figure 1:
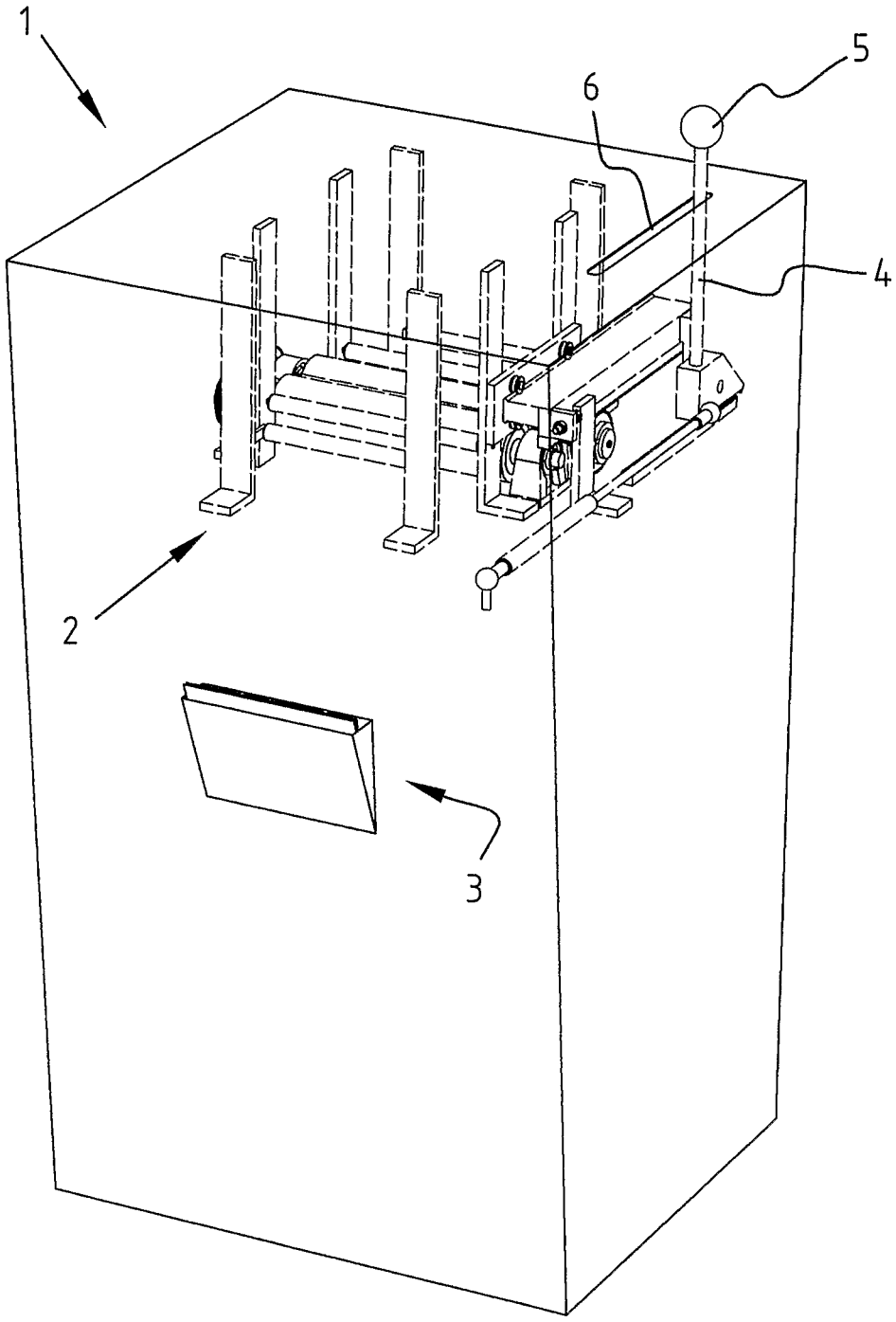
FIG. 1 is a perspective view of a first embodiment according to the present invention having therein in broken lines an embodiment of a removing mechanism according to the present invention.

A first embodiment (FIG. 1) according to the present invention relates to a dispensing apparatus for sheets, such as for instance sheets having a size between B5 and A1. The apparatus is operated by means of a control knob 5 which is connected to rod 4, which rod 4 can move reciprocally through slot 6 on the top side of the apparatus. The sheets are ejected on the underside in a delivery bin 3. A removing mechanism 2 is shown with broken lines on the inside of dispensing apparatus 1.

Figure 2:
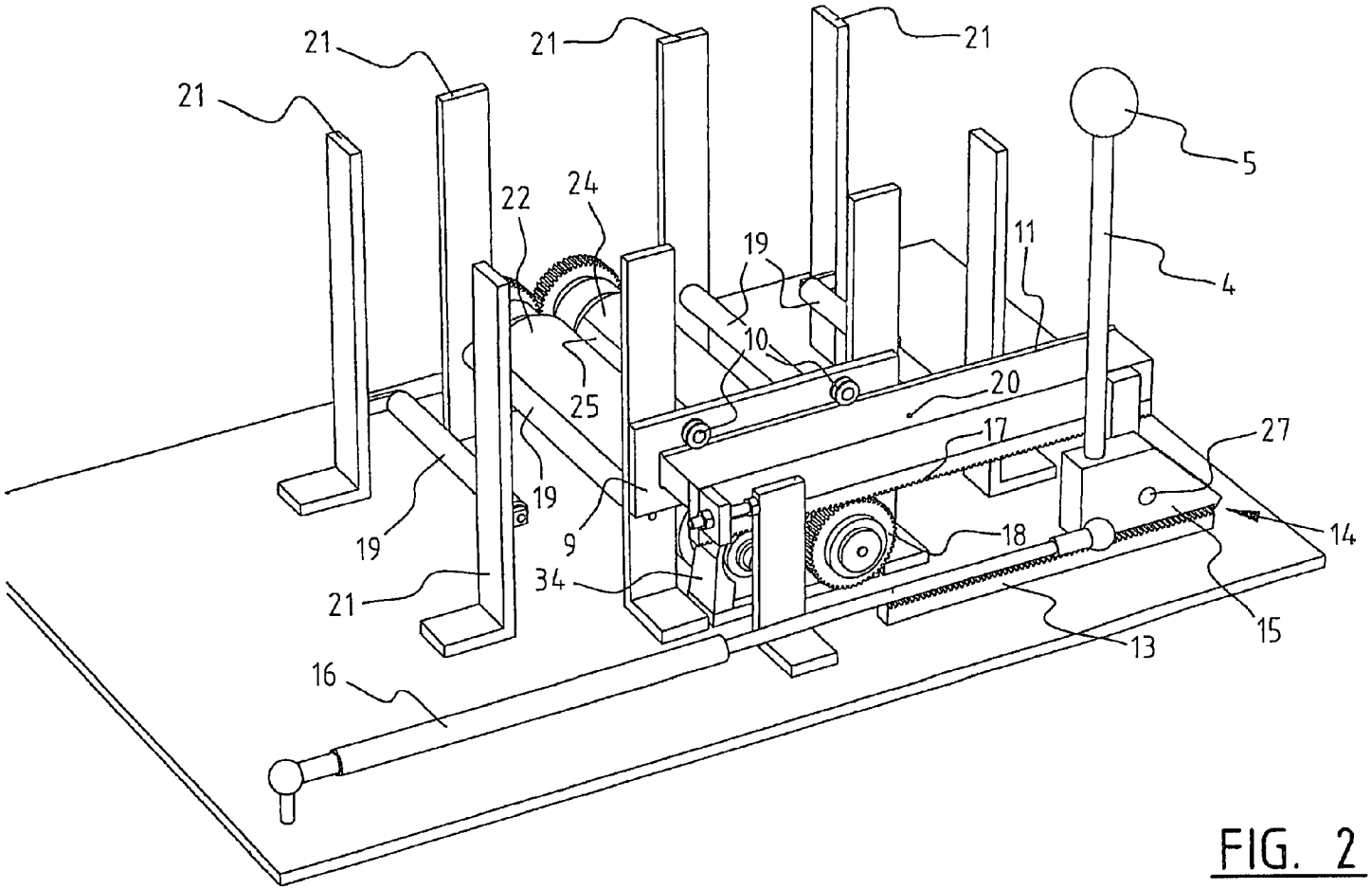
FIG. 2 is a perspective view from a side of the removing mechanism of FIG. 1.
Figure 3:
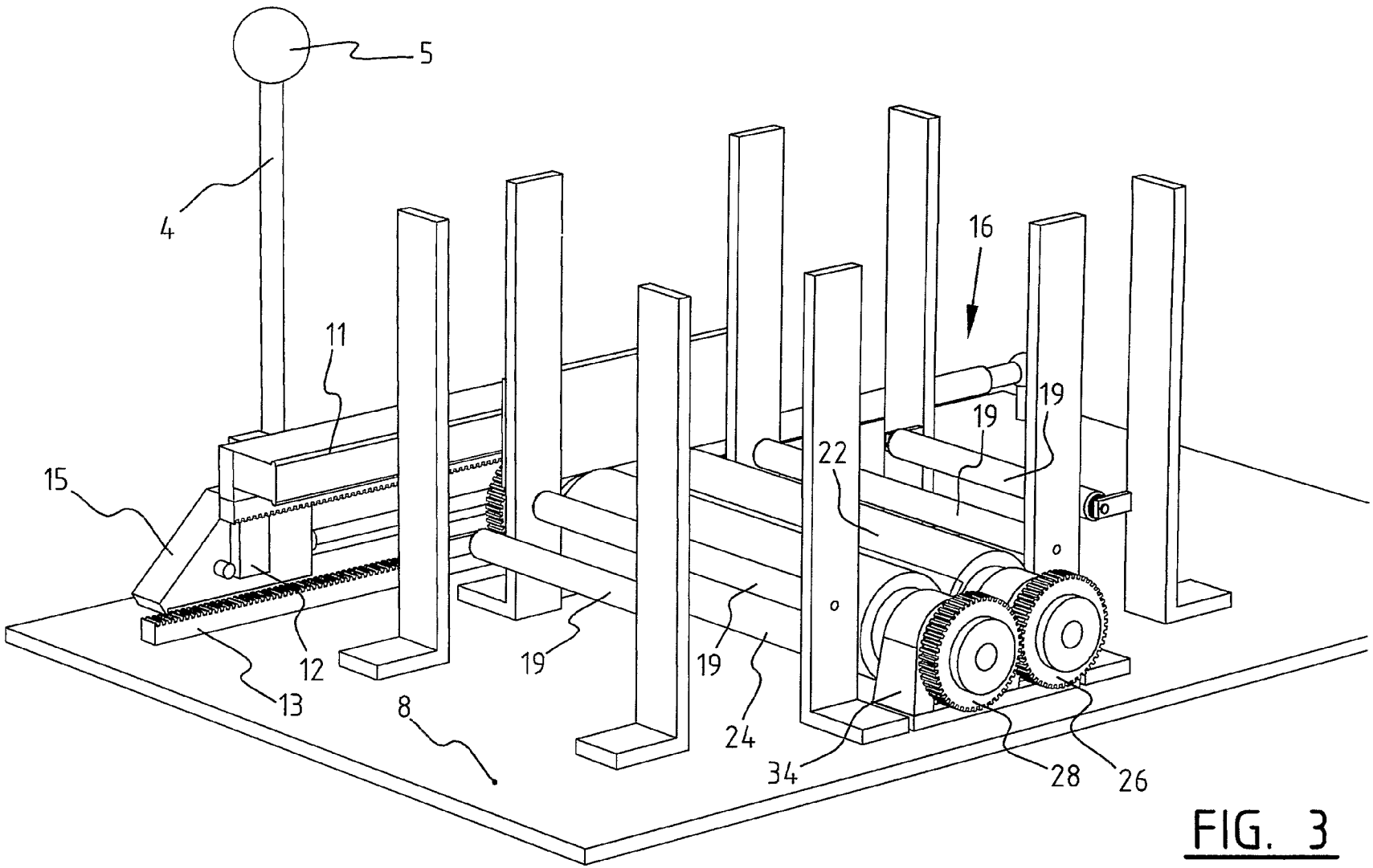
FIG. 3 is a perspective view of the embodiment of FIG. 2 from another side.

FIGS. 2 and 3 show an embodiment of the removing mechanism in greater detail. The removing mechanism is positioned on a baseplate 8. Fixed to this baseplate 8 are uprights 21, inside which uprights the surface area of a stack of sheets can be situated. Horizontal carriers 19 are fixed to the uprights. These carriers are preferably bearing mounted such that they can rotate freely about a central axis thereof. A stack of sheets can be placed on these supports 19. This stack of sheets further supports on two rollers 22 and 24 which are mounted on baseplate 8 close to the centre of the space for the stack of sheets by means of bearings 34. On one side of rollers 22, 24 are mounted toothed wheels 26, 28, the teeth of which engage together such that, if one roller is set into rotation, the other roller will counter-rotate relative to the first roller. A toothed wheel 18 is arranged on the other side of roller 24. This toothed wheel 18 is connected to roller 24 for driving in one direction. In the other direction toothed wheel 18 has a clearance relative to roller 24. The roller can hereby be driven in one direction by means of toothed wheel 18.

A bearing plate 9 is fixed to two of the uprights 21. Four wheels 10 are mounted on this bearing plate 9. The upper two hereof are shown; the lower two are out of view.

The removing mechanism is driven by means of drive rod 4 with knob 5 on the top side. This drive rod is connected to drive block 15, to which is fixed a connecting bar 12. This connecting bar 12 connects drive block 15 to a drive beam 20. This drive beam 20 is provided on the underside with a toothed rod 17 which engages in toothed wheel 18. Two protruding edges 11 are situated on the other side of beam 20 on the bottom and top side thereof. These edges run through grooves of wheels 10.

Drive block 15 is fixed to connecting bar 12 by means of a shaft 27. The drive block can rotate about this shaft. On the front side of drive block 15 is mounted a damper or a gas spring 16, which is fixed on the front side thereof on baseplate 8. This gas spring or damper 16 serves to push back drive block 15 with a predetermined delay. A time delay is hereby caused in the number of sheets which can be successively removed. A toothed strip 13 is also situated on baseplate 8. This toothed strip 13 co-acts with blocking tooth 14 on drive block 15. If a user of the device wishes to accelerate the return of drive rod 4 to the starting position in order to be able to remove a subsequent sheet more quickly, drive block 15 will rotate about shaft 27 and blocking tooth 14 will come to lie against one of the teeth of toothed strip 13. This forces the time delay caused by the speed at which the gas spring or damper moves back the drive block. A user cannot cause the apparatus to function any quicker.

Figure 4A:
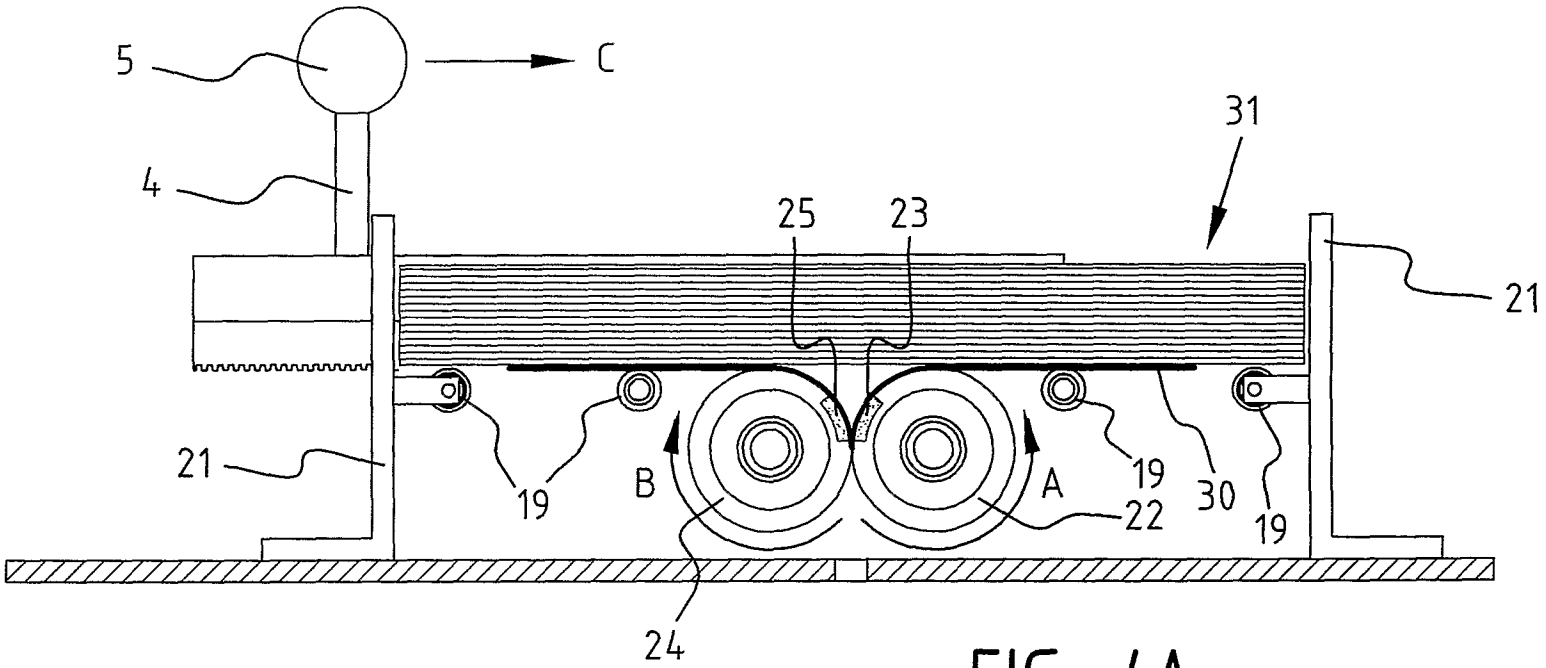
FIGS. 4*a* and 4*b* are side views of the embodiment of FIGS. 2 and 3 at a different stage of operation.
Figure 4B:
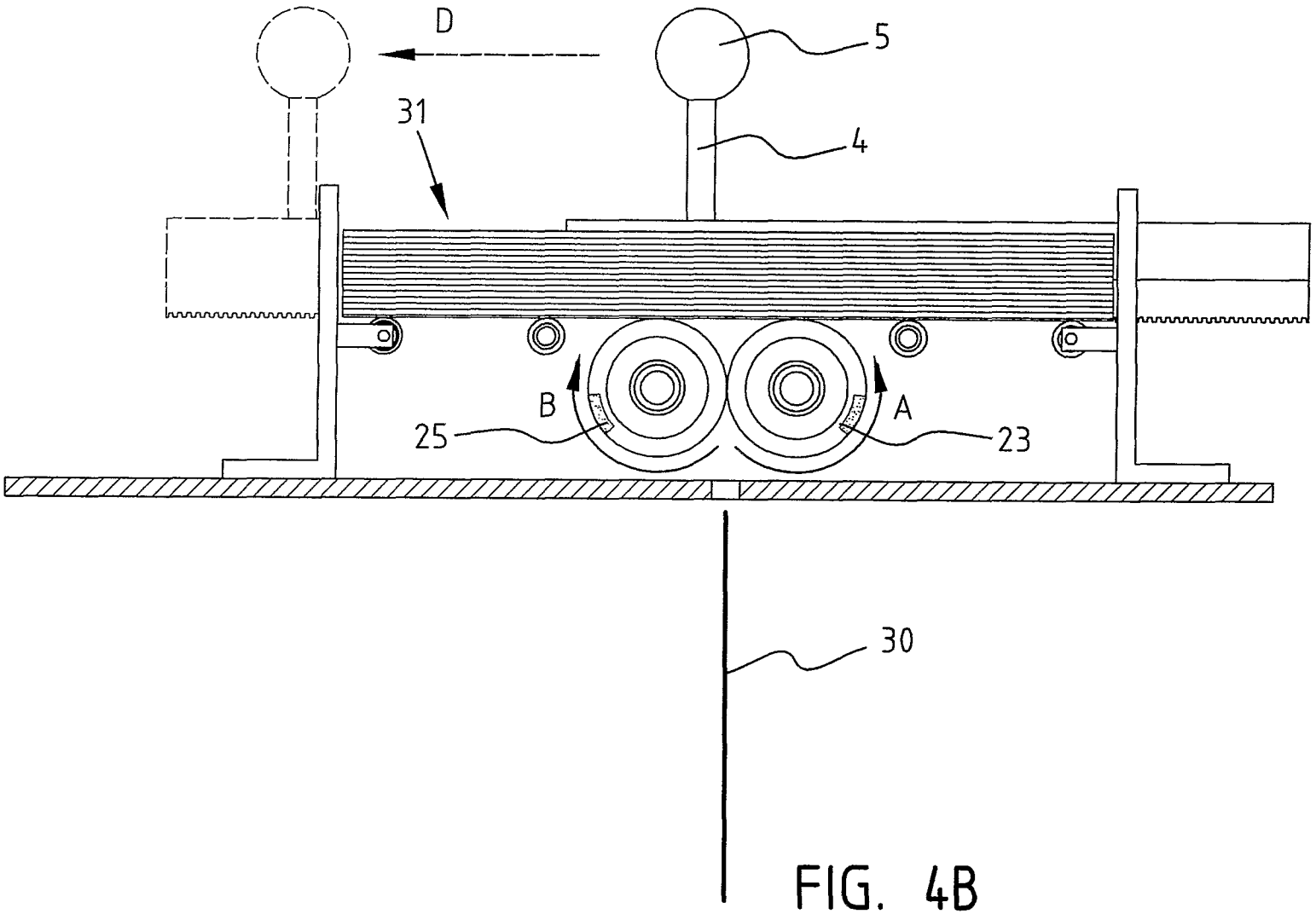

The operation will now be further elucidated with reference to FIGS. 4*a* and 4*b*. This side view shows how a stack of sheets 31, for instance a stack of paper such as maps or brochures, is arranged in the apparatus between uprights 21 on supports 19 and rollers 22, 24. For the sake of clarity the bottom sheet 30 is shown with an extra-thick line. By moving drive rod 4 in the direction of arrow C using handle 5, rollers 22 and 24 are rotated respectively in the direction of arrows A and B. The rough strips 25 and 23 of respective rollers 24 and 22 engage on the bottom sheet when they are situated in the topmost rotational position. From this position of engagement of the rough strip on the sheet the rollers in the view of FIG. 4*a* are rotated substantially a quarter-turn further in the direction of arrows A and B. The sheet is hereby entrained by the rollers close to the centre thereof, and in the view of FIG. 4*a* the point of the fold lies exactly between rollers 24 and 22.

As the rotation of the rollers along the arrows progresses further, the orientation as shown in FIG. 4*b* is reached. Sheet 30 is herein folded completely double and already released from between the rollers. A slot in the baseplate has allowed this sheet 30 to pass through. Sheet 30 can then come to lie in delivery unit 3 (FIG. 1) via a slide chute (not shown).

From the moment that both ends of sheet 30 have passed over the top side of rollers 22 and 24, the following sheet is in contact with the rotating rollers. Owing to the smooth surface the roller will not engage on this following sheet. The moment the rollers have rotated in the direction of arrows A and B so far that the strips 23 and 25 with the high-friction surface come to lie at the position of the following bottom sheet, the above process will be repeated. The centre of the sheet will be urged downward between the rollers and come to lie in the position shown in FIG. 4*a*.

A further embodiment (FIGS. 5, 6*a*, 6*b*) relates to an assembly wherein the whole surface of the rollers has a high friction. A result hereof is that the rollers will engage on a sheet of paper in any rotational position. In order to prevent immediate engagement on a following sheet when the ends of the bottom sheet reach the top side of the rollers during the throughfeed process, this embodiment is provided with lifting plates 51, 52 which lift the stack of sheets to a position slightly above the surface of the rollers.

For this purpose the outer end of rollers 61, 62 is provided with cams 63, 64. The plates are further provided with rolls 65, 66. It is possible to arrange such cams and rolls on either side of the rollers and the plates. When a user wishes to remove a sheet of paper, he sets the installation into operation. At this moment the stack of paper must be in contact with the top side of the rollers and the lifting plates are situated in the low position. The bottom sheet will now be fed through between the rollers in a manner as shown in FIG. 4*a*. In this embodiment the smooth surfaces of the rollers herein serve as throughfeed transport members due to the pressure on either side of the folded sheet. Since the sheets must be carried out separately of each other, it is recommended that stack 31 is raised by means of lifting plates 51 and 52 before the two ends of the sheet reach the top side of the rollers. The surface of the roller will hereby not engage on the following sheet and the bottom sheet being fed through will be carried out separately.

For mounting purposes the plates 51 and 52 are provided on the underside with rotation shafts 69 and 70. These rotation shafts are for instance arranged in uprights similar for instance to uprights 21 of FIG. 2. For support of the stack of paper 31 bearing-mounted supports 67 and 68 are further provided on both sides.

Figure 5:
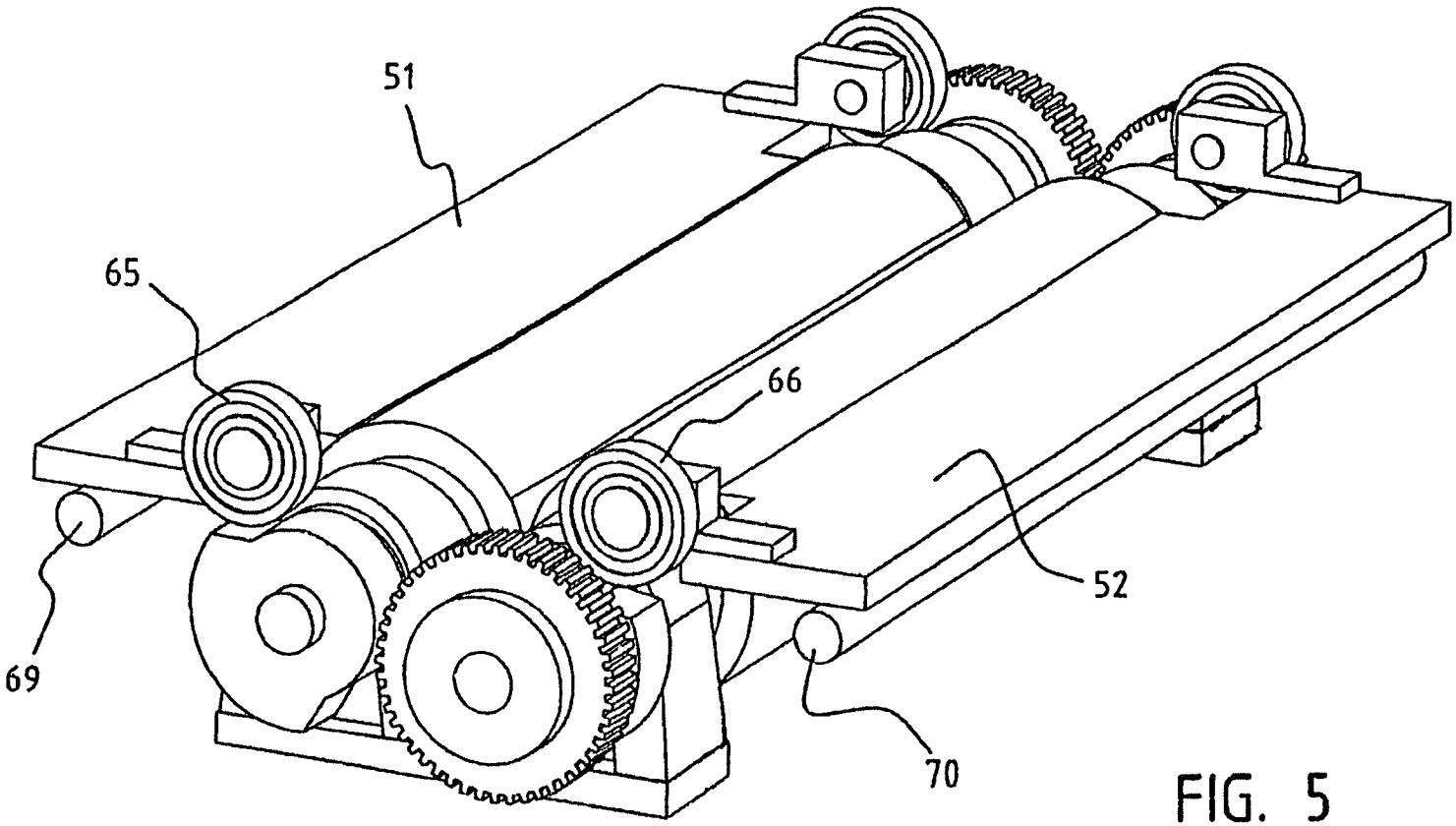
FIG. 5 shows a further embodiment in perspective.
Figure 6A:
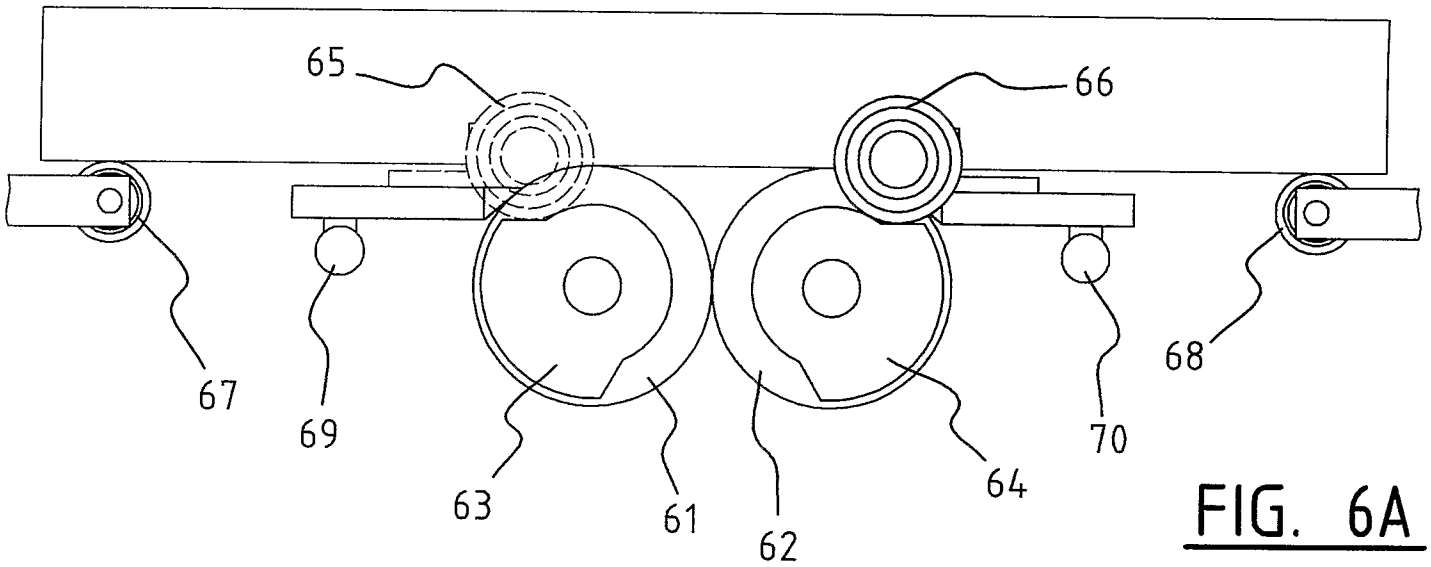
FIGS. 6*a* and 6*b* show the embodiment of FIG. 5 in side view at different stages of operation.
Figure 6B:
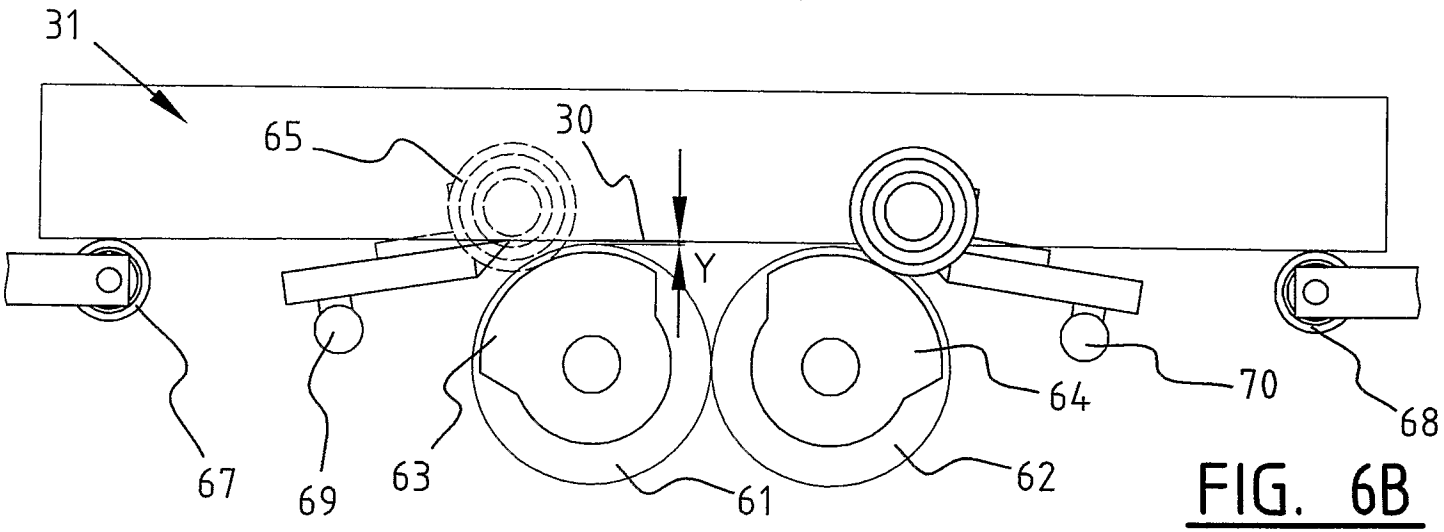

It is further possible to envisage an embodiment with rollers having smooth surfaces with rough strips, wherein the plates according to the embodiment of FIG. 5 are applied. This is for instance advantageous for occasional re-calibration of the system by lifting the stack of paper and rotating the rollers back and forth. A further embodiment provides for the application of for instance an electric motor for the purpose of rotating the rollers as well as for moving the lifting plates 51 and 52 up and downward, which can also take place independently of each other in such an embodiment. In this embodiment a control unit is further provided for actuating the motor for the purpose of rotating the rollers and the motor for moving the lifting plates up and downward. Such a control unit can further be provided with a time control for the purpose of the time delay between two sheets for dispensing. As already stated in the foregoing, such an embodiment may also include the option of distributing several sheets in rapid succession, whereafter there is a pause.

Figure 7:
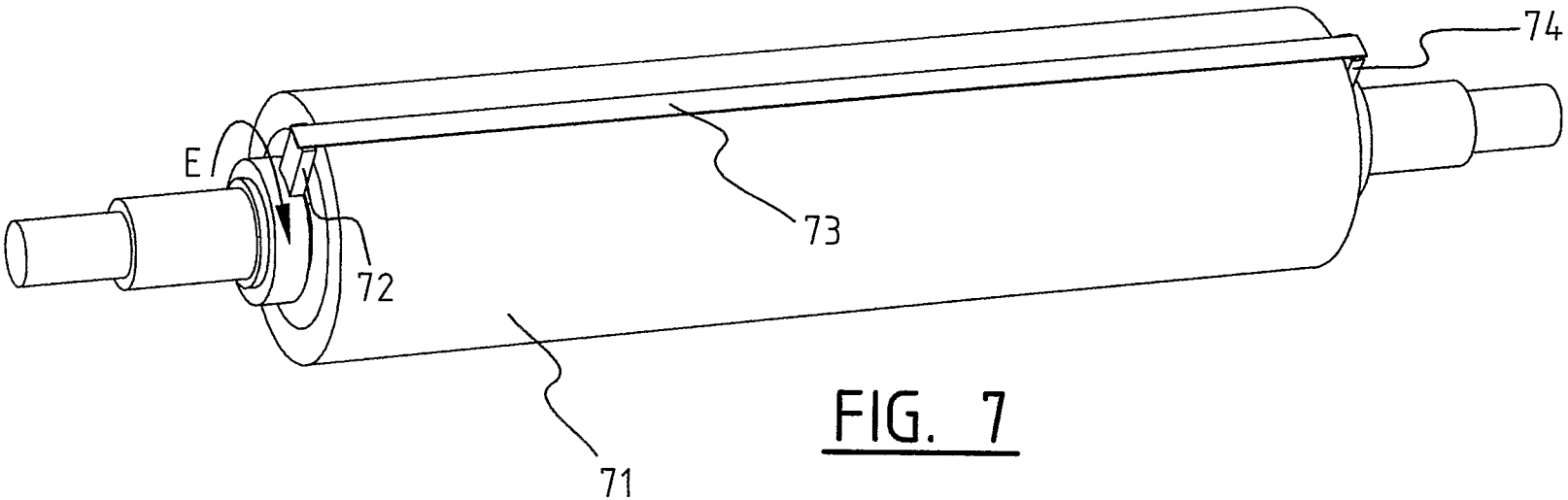
FIG. 7 is a perspective view of a further embodiment according to the present invention.

FIG. 7 shows a roller 71 with a smooth surface and with a strip 73 which is movable relative to the roller and has a relatively high friction relative to the rest of the surface of the roller. The shaft of the roller comprises different layers which can be driven separately of each other. Fixed to the outer layer thereof are connecting elements 72 and 74. Between these connecting elements 72 and 74 is arranged the high-friction strip, which can rotate directly above the surface of roller 71.

If roller 71 were applied for instance in the embodiment of FIG. 2, for instance instead of the roller 24 thereof, this roller 71 can in this position rotate freely in the apparatus, wherein the bottom sheet will not be entrained since the whole surface is smooth. The moment a sheet is desired, the roller will be set into motion. At this moment the bottom sheet will still be in place. The shaft with connecting pieces 72 and 74 between which is arranged strip 73 is then set into rotation in the direction of arrow B (FIG. 4A). From the moment that high-friction strip 73 is situated between the top side of roller 71 and the underside of the bottom sheet, friction will be created between the strip and the bottom sheet, whereby the strip will be carried along. From the moment that the roller has rotated so far that strip 73 is once again released from the position between the roller and the entrained sheet of paper, this strip will be brought to a stop somewhere in the free position. This can for instance be the bottom position, wherein use can be made of the force of gravity. Another position in which no engagement will occur between the roller and the paper is also possible.

Figure 8:
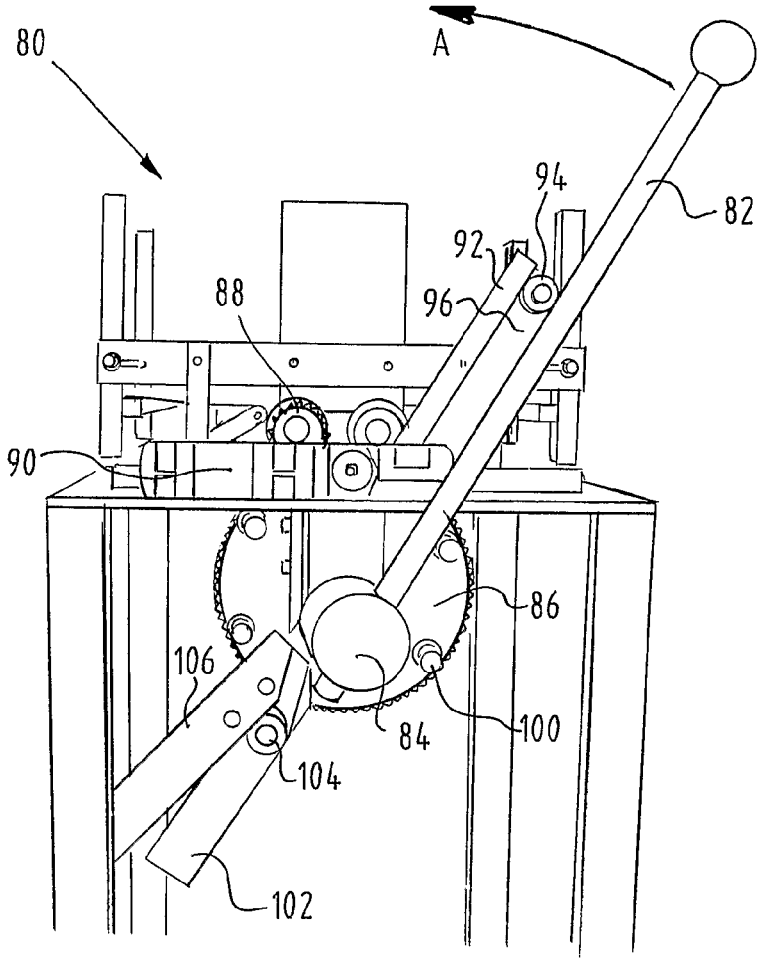
FIG. 8 shows a front view of a further embodiment according to the present invention.
Figure 9:
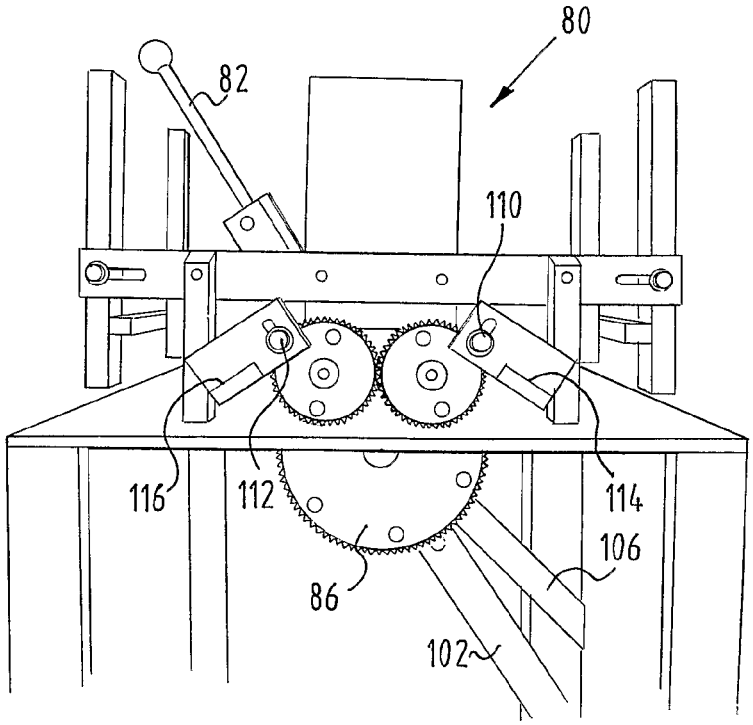
FIG. 9 shows a rear view of the embodiment of FIG. 8.

A further embodiment (FIG. 8,9) relates to an assembly 80 with a drive, wherein by means of a drive rod 82, which can be moved in the direction of arrow A, one sheet is distributed when a stroke is made. This is shown in FIG. 8. The rotation of rod 82 sets shaft 84 into rotation, preferably through an angle of 60° per stroke of drive rod 82. This has the advantage compared to a translating drive that less force is required and an optional time delay can be incorporated more readily in the apparatus. Shaft 84 is connected to toothed wheel 86 with which toothed wheel 88 is driven, which then sets the remaining components of assembly 80 into motion as described above. In this preferred embodiment, toothed wheel 88 has twenty teeth and toothed wheel 86 has one hundred and twenty teeth, whereby toothed wheel 88 revolves once in one stroke of drive rod 82 when toothed wheel 86 has an angular rotation of 60". The circumference of toothed wheel 88 is preferably equal to half the length of the sheet to be dispensed. In this embodiment there is also provided a damper 90 which returns drive rod 82 to its starting position after the removal of a sheet, as shown in FIG. 8. A preferably adjustable time delay is hereby realized between the removal of successive sheets. This damping preferably cannot be forced by a user. Assembly 80 provides an arm 92 mounted on damper or self-closing device 90, which by means of stop 94 on arm 96 co-displaces this arm to the starting position. Ratchet 98 (not shown) blocks undesired rotation of toothed wheel 86 and interacts with protrusions 100 fixed on toothed wheel 86, wherein six of these protrusions are preferably used to correspond with the preferably 60° angular rotation of shaft 84. If desired, a counting mechanism can be provided to keep count of the number of strokes and dispensed sheets. On the underside of toothed wheel 86 is preferably situated a counter-arm 102, opposite arm 96, which interacts with support 106 by means of stop 104. As soon as toothed wheel 88 has been set into rotation, it causes both rollers to rotate in the same way as discussed above by means of the toothed wheels, preferably placed on the other side of the frame, as shown in FIG. 9. Instead of lifting plates 51 and 52 as shown in FIG. 5, the preferred embodiment shown in FIG. 9 makes use of lifting rods 110, 112 which are raised by lifting arms 114, 116 by means of a cam mechanism as shown at the lifting plates. The point of attachment of arms 114, 116 is here lower in vertical direction than lifting rods 110, 112. The stack for distributing can optionally be pressed more firmly onto the apparatus by means of a pressing means (not shown) so as to prevent for instance slippage.

Figure 10A:
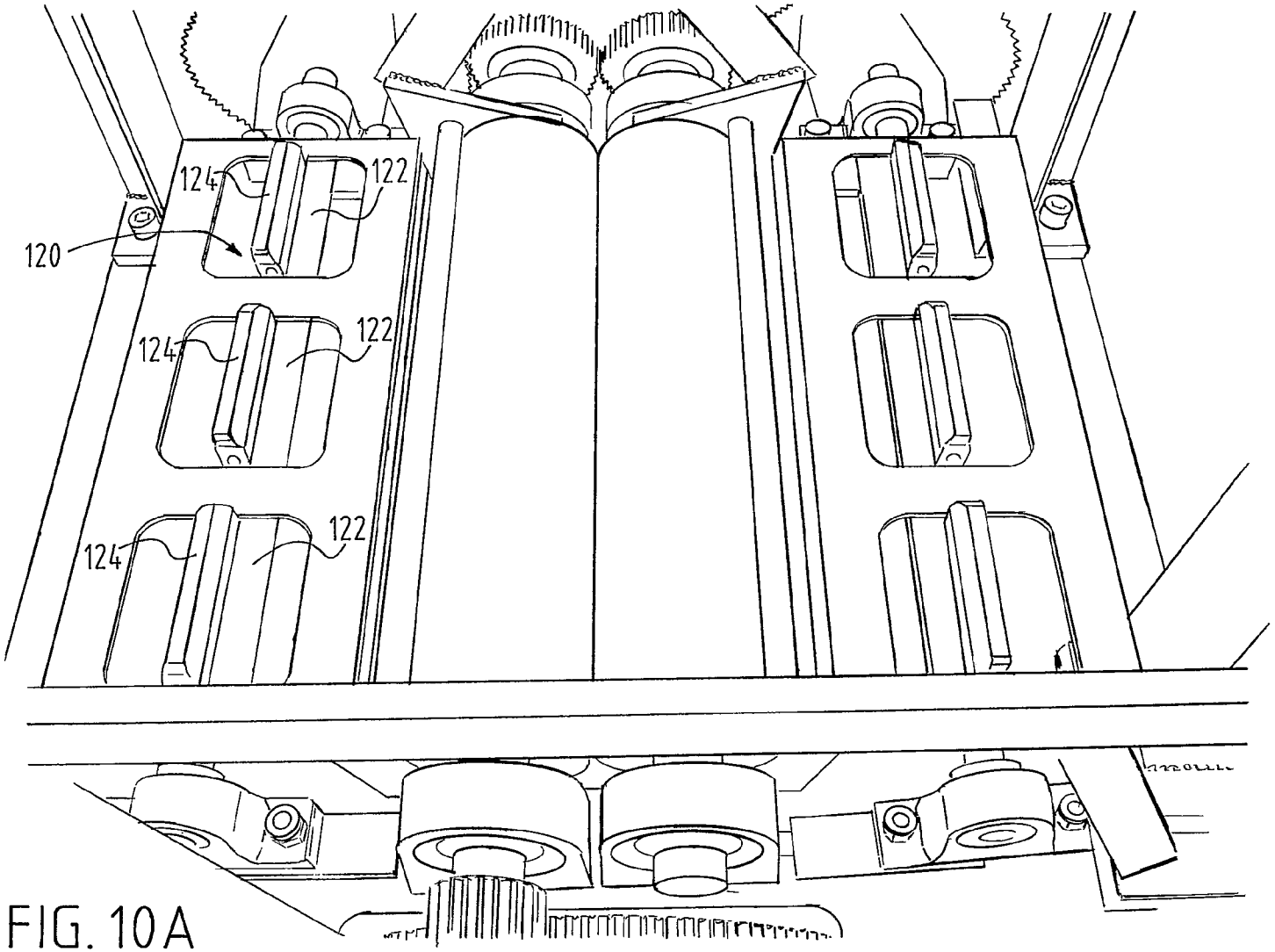
FIG. 10A shows a view with the engaging means and FIG. 10B a top view of the drive of the engaging means.
Figure 10B:
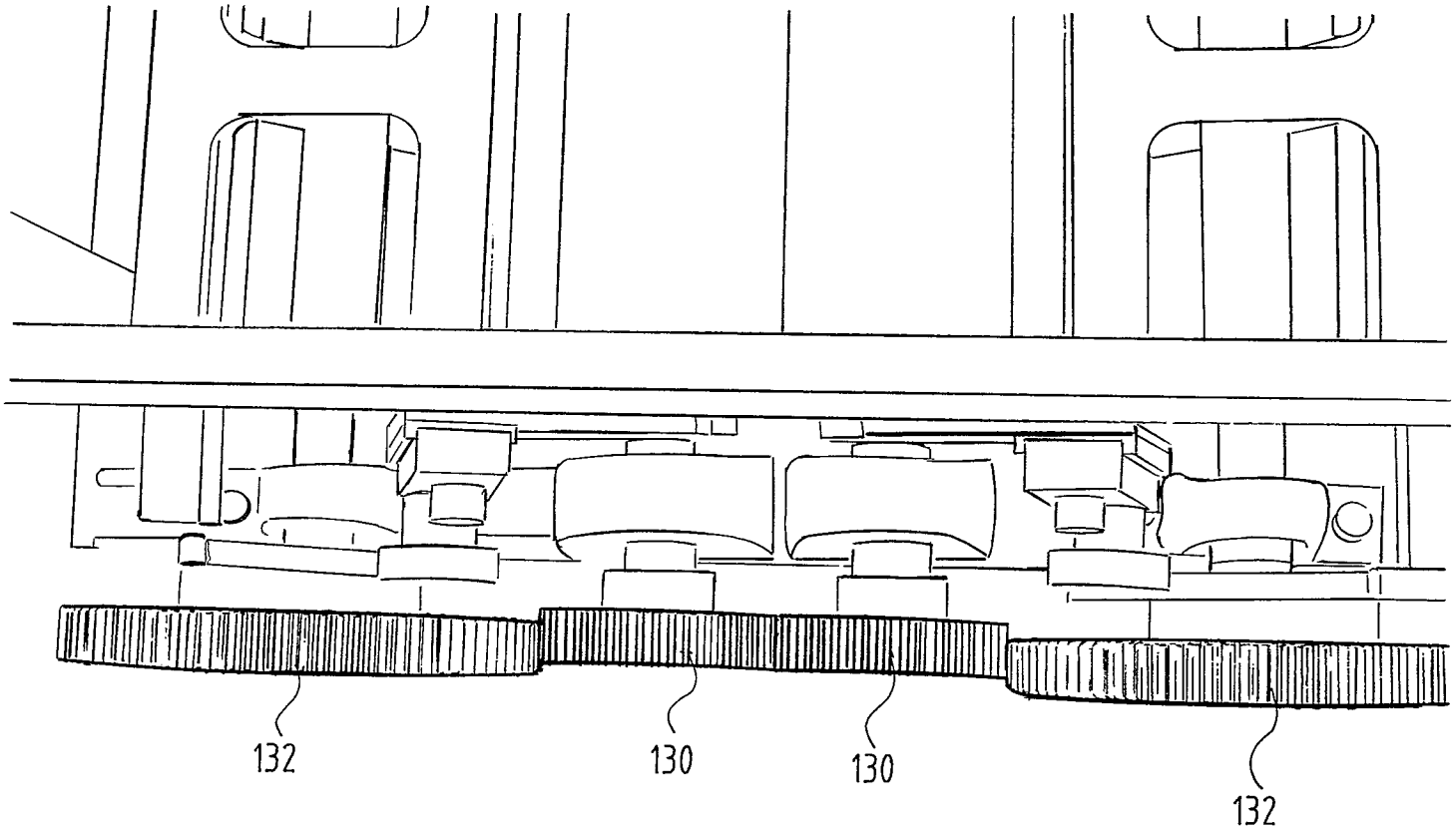
Figure 11:
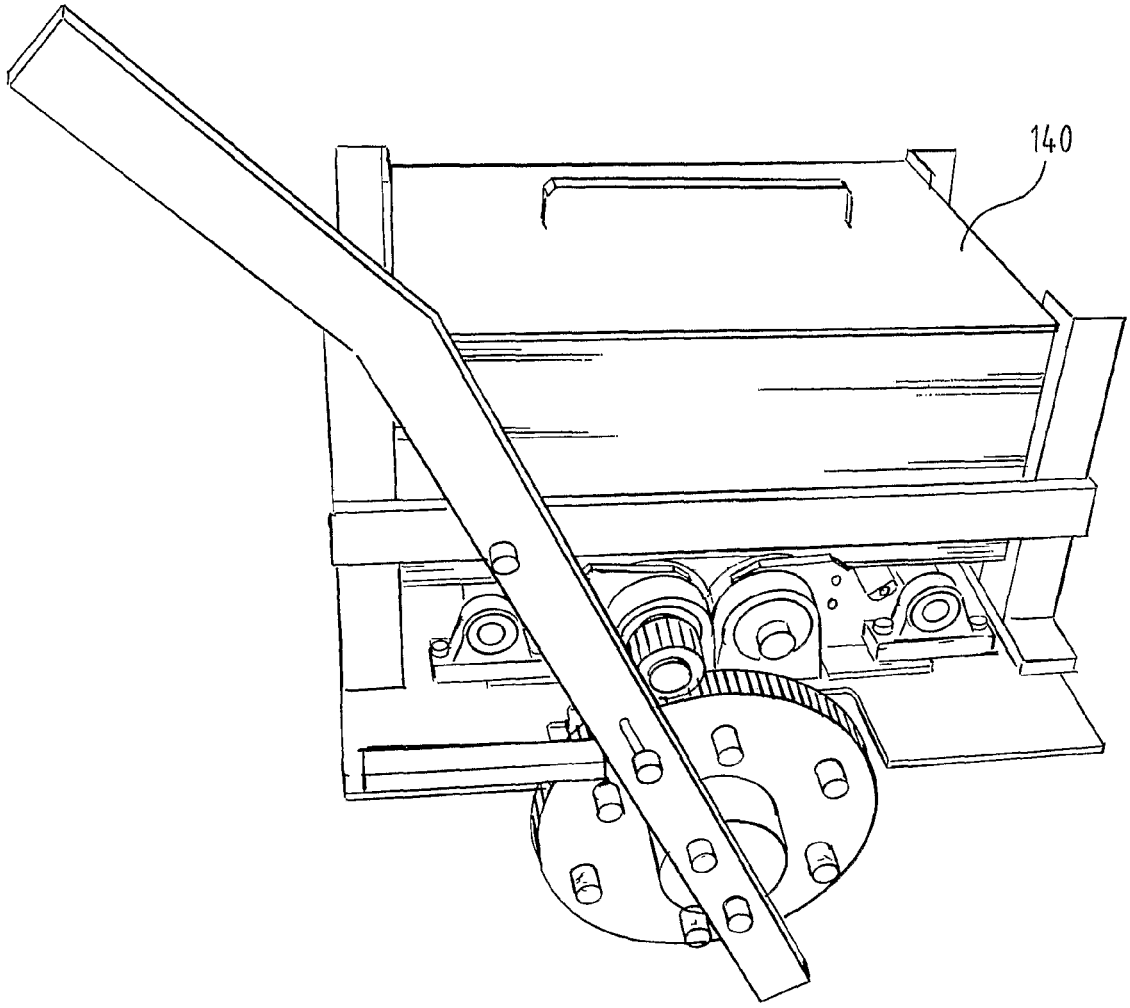
FIG. 11 shows a pressing plate of an embodiment according to the present invention.

Lifting plates 51 and 52 (FIG. 5) or lifting rods 110, 112 (FIG. 9) raise the stack of sheets as soon as the bottom sheet has passed the relevant positions in order to prevent sagging of the stack of sheets to some extent. A further measure for preventing this sagging relates to engaging means 140, comprising a shaft 122 and pins 124 in the form of protruding pins or strips or bands which pull the stack further outward (FIG. 10A) through the openings in the lifting plates. It will be apparent that these engaging means can also be embodied in the form of rollers with one or more friction strips. The shaft of engaging means 140 is driven simultaneously with the rollers, wherein toothed wheel 130 of the rollers preferably comprises 50 teeth and toothed wheel 132 for driving the engaging means comprises 100 teeth. As shown in FIG. 10B, this results in two rows of pins or strips being placed opposite each other on the shaft of the engaging means. During the dispensing of a sheet the lifting members and the engaging means are preferably situated about simultaneously at the highest point. In order to optimize the operation of the engaging means, use is preferably made of a pressing plate 140 as shown in FIG. 11, which presses the stack of sheets over practically the whole surface since in the rest position of the apparatus the centre of the stack will lie slightly higher than the edges, and during dispensing of a sheet the edges of the stack of sheets will lie higher than the centre as a result of the lifting members and possible engaging means.

The present invention is not limited to the above description of the embodiments. Different measures of the diverse embodiments can be combined with each other. The rights sought are defined by the appended claims.

The invention claimed is:

1. Dispensing apparatus for sheets, comprising:

a removing mechanism configured to contact a bottom sheet of a stack of sheets, the removing mechanism configured to grip and fold the bottom sheet using a frictional force;

a delaying member for a delay of a predetermined time between the dispensing of two successive sheets;

an actuating mechanism for driving the removing mechanism, wherein the actuating mechanism is driven by way of a physically supplied mechanical drive force of an operator of the dispensing apparatus; and an engaging structure located on lateral sides of the removing mechanism and configured to pull ends of the bottom sheet in an outward direction to fan out the bottom sheet, the outward direction existing in a plane that is about perpendicular to a direction of sheet discharge from the dispensing apparatus, the engaging structure including lifting plates, the lifting plates provided with openings through which at least one of pins, strips and bands contact the bottom sheet to pull on the ends of the bottom sheet.

2. Dispensing apparatus as claimed in claim 1, wherein a handle is provided for the purpose of operating the actuating mechanism with human muscle power.

3. Dispensing apparatus as claimed in claim 2, wherein the handle exerts a moment on the removing mechanism by way of an arm.

4. The dispensing apparatus as claimed in claim 1, wherein the removing mechanism is configured to grip the bottom sheet by the mid-section of the sheet.

5. Removing mechanism for removing a sheet from the bottom of a stack of sheets, comprising:

a support member for supporting the stack of sheets;

two counter-rotatable rollers configured to contact the bottom sheet of the stack, the counter-rotatable rollers configured to grip and fold the bottom sheet;

an actuating mechanism for driving the counter-rotatable rollers;

means for causing an engagement, by way of frictional forces, between at least one of the rollers and the bottom sheet of the stack during one or more rotation stages of the rollers;

an engaging structure located on lateral sides of the two counter-rotatable rollers and configured to pull ends of the bottom sheet in an outward direction to fan out the bottom sheet, the outward direction being a direction that is away from, and about perpendicular to, a longitudinal length of the counter-rotatable rollers, the engaging structure including lifting plates, the lifting plates provided with openings through which at least one of pins, strips and bands contact the bottom sheet to pull on the ends of the bottom sheet.

6. Removing mechanism as claimed in claim 5, wherein one rotation of one of both rollers is equal to half the length of a sheet to be removed.

7. Removing mechanism as claimed in claim 5, wherein one rotation of the roller corresponds to one stroke of the actuating mechanism.

8. Removing mechanism as claimed in claim 5, wherein the rollers comprise a surface with a low friction and the surface of the rollers, as seen in the longitudinal direction, comprises a strip with a high friction, and wherein the transition between the coefficient of friction of a roller and the high-friction strip can proceed gradually in a predetermined manner.

9. Removing mechanism as claimed in claim 5, wherein the counter-rotatable rollers comprise an elastic material close to the surface thereof.

10. Removing mechanism as claimed in claim 5, wherein a strip with the high friction has a slightly raised surface relative to the rest of the surface of the roller or is arranged in the roller, wherein the strip is provided with resistance devices, and is arrangeable in a freely movable manner in the immediate vicinity of or against the surface of at least one of the rollers.

11. Removing mechanism as claimed in claim 5, wherein the roller comprises a metal surface.

12. Removing mechanism as claimed in claim 5, comprising a lifting member for varying the height position of the stack of sheets close to the rollers during one or more rotation stages of the rollers.

13. Removing mechanism as claimed in claim 12, wherein the lifting member comprises two lifting supports on either side of the rollers.

14. Removing mechanism as claimed in claim 13, wherein the lifting supports on either side of the rollers are placed at an angle relative to the stack of sheets.

15. Removing mechanism as claimed in claim 12, wherein a cam is arranged on at least an outer end of at least one of the rollers for the purpose of actuating the lifting member.

16. Removing mechanism as claimed in claim 5, comprising means for placing the stack and the rollers under bias relative to each other.

17. Removing mechanism as claimed in claim 5, wherein a delaying member is provided for a delay of a predetermined time between the dispensing of two successive sheets.

18. Dispensing apparatus for sheets, comprising a delaying member for a delay of a predetermined time between the dispensing of two successive sheets;

an actuating mechanism for driving the removing mechanism, wherein the actuating mechanism is driven by way of a physically supplied mechanical drive force of an operator of the dispensing apparatus, and a removing mechanism as claimed in claim 5.

19. Dispensing apparatus for sheets, comprising:

a removing mechanism as claimed in claim 5;

a motor for driving the removing mechanism; and a delaying member for allowing the removing mechanism to be driven by the motor with a time delay, with a predetermined time between the dispensing of two sheets.

20. Removing mechanism as claimed in claim 5, wherein the outward direction exists in a plane that is about perpendicular to a sheet discharge direction.

21. Method for dispensing sheets from a stack, comprising:

stacking the sheets;

fanning out a bottom sheet of the stack of sheets by pulling on ends of the bottom sheet in an outward direction using an engaging structure, the outward direction existing in a plane that is about perpendicular to a sheet discharge direction, the engaging structure including lifting plates, the lifting plates provided with openings through which at least one of pins, strips and bands contact the bottom sheet to pull on the ends of the bottom sheet;

contacting a bottom sheet of the stack of sheets, while the bottom sheet remains on the stack of sheets, with two counter-rotatable rollers;

gripping a mid-section of the bottom sheet with the rollers using a frictional force applied by at least one of the rollers, wherein the gripping step includes the rollers only gripping the bottom sheet, and not multiple sheets, due to the fanning out of the bottom sheet by the engaging structure; and drawing the bottom sheet through the rollers via rotation of the rollers;

folding the bottom sheet as the bottom sheet is drawn through the rollers; and discharging the sheet in the sheet discharge direction.

22. Method as claimed in claim 21, wherein the counter-rotatable rollers are driven by way of manpower.

23. Method as claimed in claim 21, wherein a delaying member prevents dispensing of two successive sheets within a predetermined time.

24. Method as claimed in claim 21, wherein the stack of sheets is lifted up during one or more rotation stages of the rollers.

25. Method as claimed in claim 21, wherein the folding of the bottom sheet includes folding the sheet about the mid-section of the sheet, the drawing of the bottom sheet through the rollers further comprising:

drawing the mid-section of the bottom sheet through the rollers first, thereby causing two ends of the folded bottom sheet to be drawn through the rollers last.

* * * * *